United States Patent [19]

Doughty et al.

[11] Patent Number: 4,945,327

[45] Date of Patent: Jul. 31, 1990

[54] MOLDED CASE CIRCUIT BREAKER VARIABLE ARC EXHAUST SHIELD

[75] Inventors: Dennis J. Doughty; Raymound K. Seymour, both of Plainville; Aymon A. Maulandi, Plantsville, all of Conn.

[73] Assignee: General Electric Company, New York, N.Y.

[21] Appl. No.: 402,302

[22] Filed: Sep. 5, 1989

[51] Int. Cl.[5] ..... H01H 9/30

[52] U.S. Cl. ..... 335/201; 335/16; 335/147

[58] Field of Search ..... 200/147 R; 335/201, 335/16, 147, 195, 202, 132

[56] References Cited

U.S. PATENT DOCUMENTS 3,106,627 10/1963 Lisnay ..... 200/147 R
3,198,924 9/1965 Brumfield et al. ..... 200/251
4,589,052 5/1986 Dougherty .
4,649,455 3/1987 Scott .
4,754,247 6/1988 Raymont et al. .
4,845,460 7/1989 Manthe et al. ..... 335/8
4,877,929 10/1989 Rival ..... 200/146 R

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An industrial-rated molded case circuit breaker employs a pair of movable contact arms to interrupt circuit current through each phase of a multi-phase electrical power distribution circuit. A contact arm guide outboard the movable contact upon overcurrent conditions. A pair of protrusions formed on the abutting surfaces of the contact arms prevents the arms from distortion under the electrodynamic attraction generated during intense overcurrent conditions. A flexible arc gas exhaust-seal is arranged between the movable contacts and the line strap connectors to seal the circuit breaker enclosure while controllably exhausting the arc gases that occur upon such intense overcurrent conditions.

11 Claims, 4 Drawing Sheets

MOLDED CASE CIRCUIT BREAKER VARIABLE ARC EXHAUST SHIELD

BACKGROUND OF THE INVENTION

U.S. Pat. No. 4,754,247 entitled "Molded Case Circuit Breaker Accessory Enclosure" describes a so-called "integrated" circuit breaker that provides both circuit interruption as well as accessory function. This Patent is incorporated herein for reference purposes and should be reviewed for its disclosure of an accessory cover mounted on the circuit breaker cover for providing access to field-installable accessory devices. The integrated circuit breaker includes an integrated circuit electronic trip unit which allows one circuit breaker design to be used over a wide range of ampere ratings in combination with the rating plug, also mounted in the circuit breaker cover. The electronic trip unit is described within U.S. Pat. No. 4,589,052 and the rating plug is described within U.S. Pat. No. 4,649,455 both of which are incorporated herewith for reference purposes.

When such circuit breakers are used within higher ampere-rated industrial applications, a pair of contacts are employed within each phase of the electrical power distribution circuit for efficient operation during quiescent conditions and for rapid circuit interruption upon the occurrence of predetermined overcurrent conditions. U.S. patent application Ser. No. 330,521 entitled "Molded Case Circuit Breaker Movable Contact Arm Arrangement" describes one such circuit breaker and is incorporated herein for reference purposes. When such contacts become separated upon short circuit overcurrent conditions, highly ionized arcs occur that generate arc gases which must be controllably released from the circuit breaker enclosure to prevent damage to the circuit breaker enclosure without incurring extraneous electrical conduction outside the circuit breaker enclosure. An efficient arc chute arrangement for controlling the release of arc gases is described within U.S. patent application Ser. No. 344,936 entitled "Compact Current Limiting Circuit Breaker", which Patent Application is incorporated herein for reference purposes.

U.S. patent application Ser. No. 292,717 entitled "Molded Case Circuit Breaker Line Strap Configuration" describes the cooperation between the circuit breaker line straps and the circuit breaker case to prevent egress of ionized gases in the vicinity of the line strap terminals.

The instant invention relates to means for guiding the motion of a pair of movable contact arms upon the occurrence of overcurrent conditions and also relates to separate means for controlling the safe release of arc-generated exhaust gases to the exterior of the circuit breaker enclosure.

SUMMARY OF THE INVENTION

The invention comprises a molded case circuit breaker employing a pair of movable contact arms within each pole of a multi-pole unit. A movable contact arm guide directs the exterior surfaces of the movable contact arms during intense overcurrent conditions while projections formed on the abutting surfaces of the contact arms maintains predetermined separation between the contact arms under intense electrodynamic attraction forces. A self-adjusting arc gas exhaust-seal controls the egress of arc gases from the circuit breaker enclosure.

DESCRIPTION OF THE PREFERRED EMBODIMENT

Figure 1:
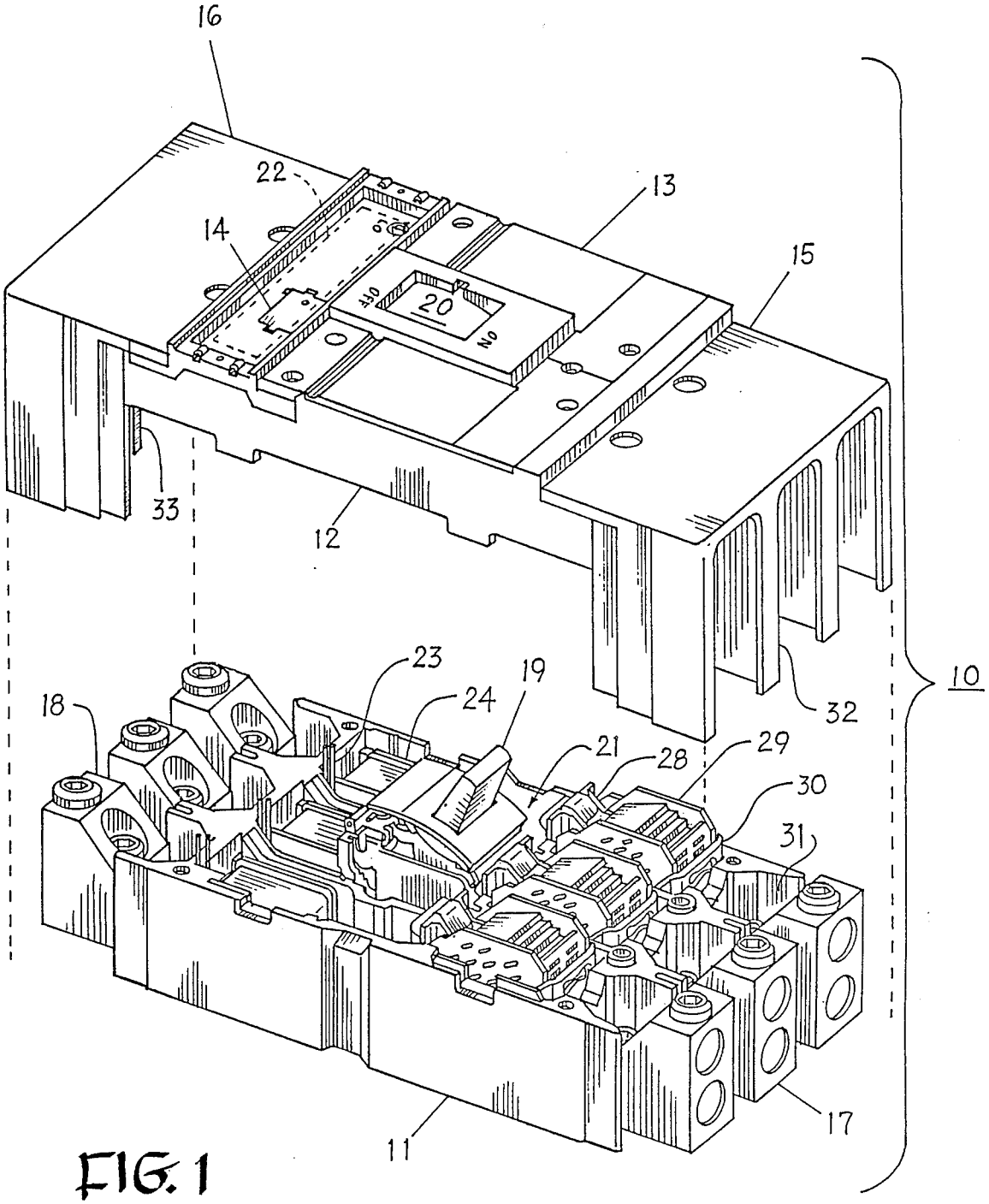
FIG. 1 is a top perspective view of the interior of an industrial-rated circuit breaker enclosure with the circuit breaker cover in isometric projection.

An industrial-rated circuit breaker 10 is shown in FIG. 1 prior to attaching the molded plastic cover 12 onto the case 11. The cover includes an accessory cover 13 similar to that described within aforementioned U.S. Pat. No. 4,754,247 and a rating plug 14 such as described within aforementioned U.S. Pat. No. 4,649,455 which interconnects with the earlier described trip unit 22. The trip unit interconnects with current sensing transformers 24 by means of the transformer pin connectors 23. The interconnection between the trip unit and current transformers is described within U.S. patent application Ser. No. 386,760 filed July 31, 1989 and entitled "Molded Case Circuit Breaker Current Transformer Assembly". The operating mechanism 21 which controls the separation of the movable contacts 26 from the fixed contacts 27 by motivating the movable contact arms 25 (FIG. 2) is similar to that described in the aforementioned U.S. patent application Ser. No. 330,521. The operating mechanism is also manually operable by means of the handle operator 19 which is accessible outside the breaker by passage through the handle slot 20 formed in the circuit breaker cover 12. The arc chute 29 described within the aforementioned U.S. patent application Ser. No. 344,936 extinguishes and cools the arc that occurs when the movable contact arms are separated upon intense overcurrent conditions. A flexible arc gas exhaust-seal, hereafter "exhaust-seal" 30, interfaces the arc chute and the line strap compartment 31 which contains the line lug connectors 17 which connect with the electric power distribution circuit. A corresponding pair of load lug connectors 18 are arranged on the opposite side of the circuit breaker case for connection with the electrical loads. The load lug cover 16 integrally-formed with the circuit breaker cover extends down and isolates the load lugs while a corresponding line lug cover 15 electrically isolates the line lugs. Baffles 32 integrally-formed with the line lug cover electrically isolate the line lugs connected with the separate phases of the polyphase electrical distribution circuit. Similar baffles 33 are integrally-formed within the load lug cover 16 to isolate the load lugs.

Figure 2:
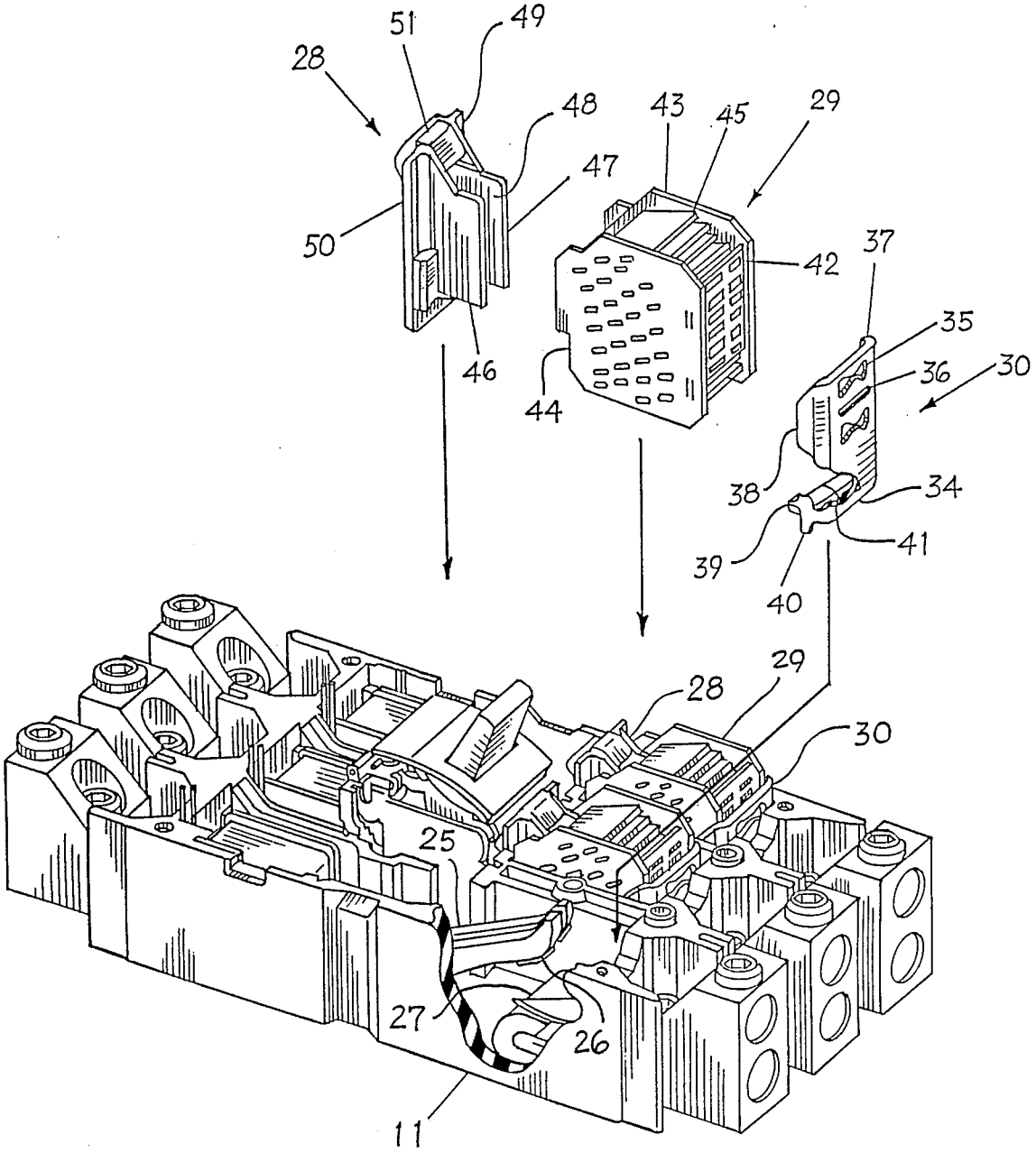
FIG. 2 is a top perspective view of the circuit breaker enclosure of FIG. 1 with the movable contact arm guides, arc chutes and arc gas exhaust-seal in isometric projection.

A movable contact arm guide 28 is arranged over the movable contact arms on the side of the arc chute opposite the exhaust-seal as best seen by referring now to FIG. 2. The guide consists of opposing side plates 46, 47 which define an opening 48 for the movement of the movable contact arms 25. The side supports 49, 50 joined by the transverse top piece 51 position and hold the contact arm guide within the circuit breaker case. As described earlier, the contact arm guide abuts against one end of the arc chute 29 which includes a pair of opposing side frames 43, 44 and arc plates 45 as indicated. Beside providing an exterior guide to the outside surfaces of the movable contact arms, the side plates 46, 47 of the contact arm guide 28 cooperate with the side frames 43, 44 of the arc chute 29 to contain the arc gases that are generated when the movable and fixed contacts 26, 27 become separated. The arc gases thereby become directed out of the arc chute through the slotted back plate 42. The flexible exhaust-seal 30, which is fabricated from an elastomeric material, abuts against the arc chute slotted back plate 42. The exhaust-seal consists of a single U-shaped configuration defining a pair of opposing side pieces 37, 38 joined by a back plate 34. A pair of flexible ventilation slots 35 having a dogbone configuration are formed in the back plate along with an intermediate rectangular slot 36 as indicated. The side tabs 39 and bottom tabs 40 position the exhaust-seal within the circuit breaker case 11 such that the pedestal 41 extending along the bottom of the exhaust-seal prevents the egress of arc exhaust gases through the floor of the circuit breaker case by becoming forced down against the circuit breaker case by the pressure generated by the arc gases. The dogbone configuration of the openings 35 allow the size of the openings to expand and increase in accordance with the intensity of arc gas pressure exerted upon the back plate. The provision of the openings 35, 36 and the elastic property of the elastomeric material allows a single exhaust-seal design to be employed over a wide range of circuit breaker ampere ratings. The more intense the overcurrent condition, the more pressure is exerted upon the pedestal 41 to increase its sealing ability while the increased pressure in turn generates a larger opening through the slots 35, 36 to accommodate the egress of the increased arc gases out from the circuit breaker enclosure.

Figure 3:
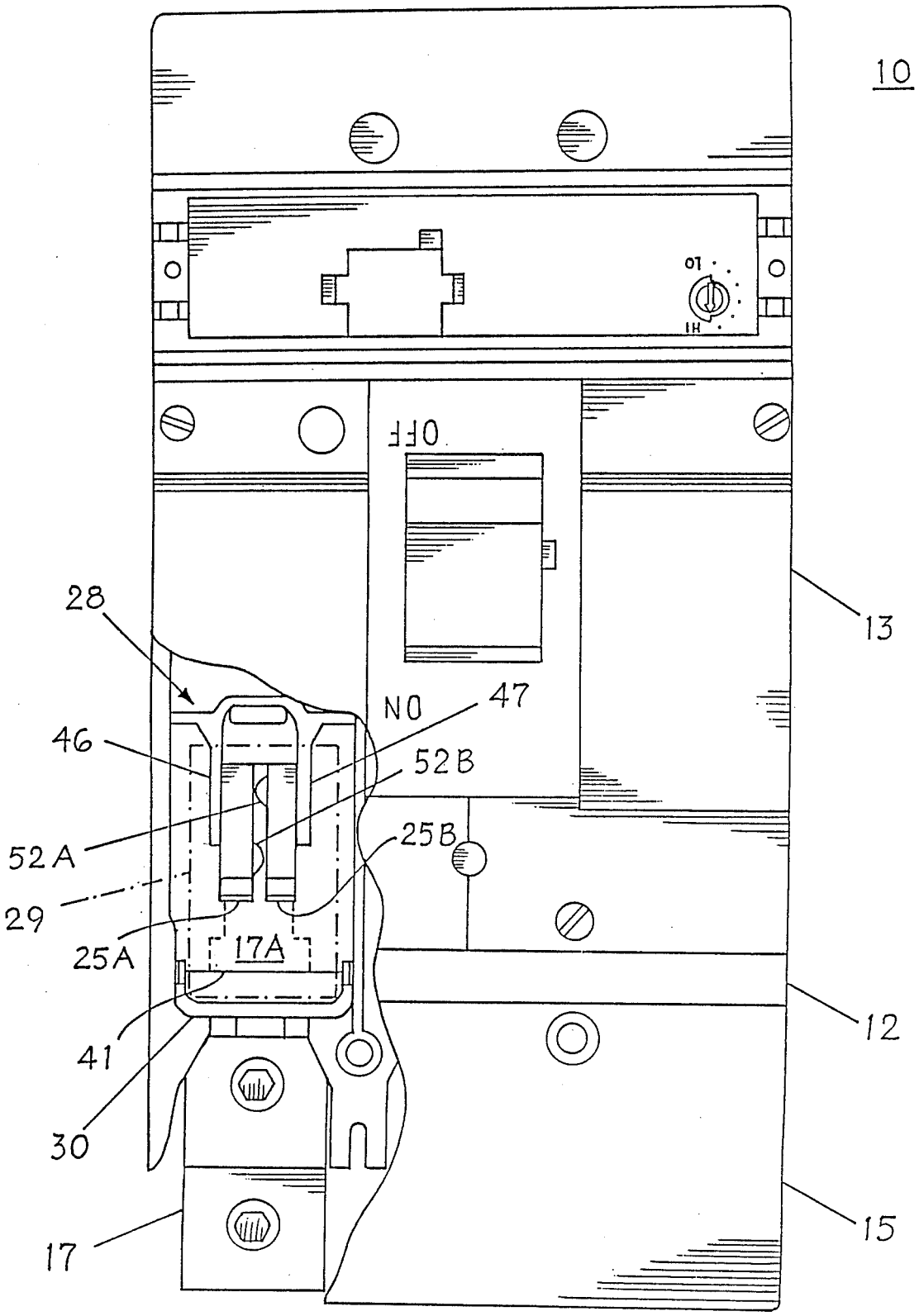
FIG. 3 is a top plan view of an assembled circuit breaker according to the invention with a part of the circuit breaker cover removed to depict the movable contact arm configuration in accordance with the invention.

The contact arm guide 28 is depicted within the circuit breaker 10 in FIG. 3 with part of the line lug cover 15, accessory cover 13 and circuit breaker cover 12 removed to depict the arrangement of the movable contact arms 25A, 25B within the side plates 46, 47 of the contact guide. The protrusions 52A and 52B formed on the inner surfaces of the movable contact arms, provide both clearance and separation for the movable contact arms when submitted to the strong electrodynamic attraction forces that occur upon overcurrent conditions. The pedestal 41 of the exhaust-seal 30 is shown subjacent the arc chute 29 which is depicted in phantom. The pedestal 41 seats on the line strap part 17A interior to the case to provide a seal between the line strap and the case in the vicinity of the line strap part to which the line lug 17 is attached.

Figure 4:
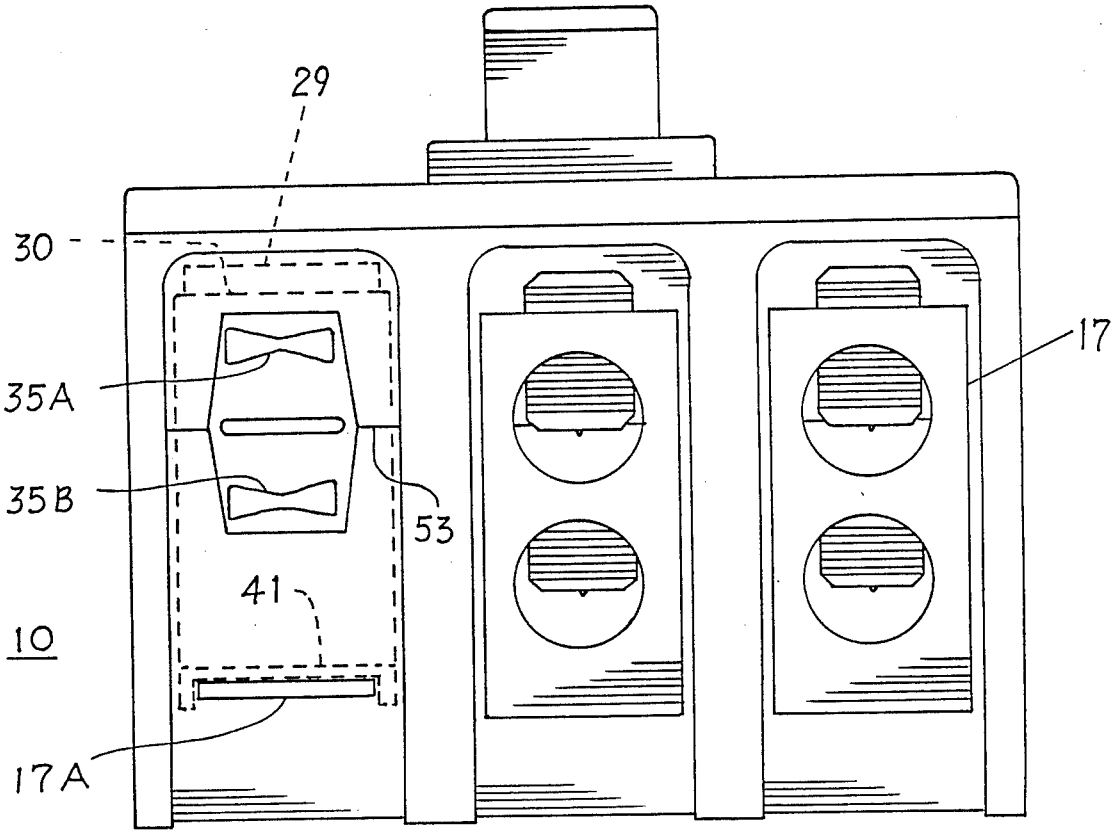
FIG. 4 is an enlarged end view of the circuit breaker of FIG. 3 depicting the arc gas exhaust-seal in accordance with the invention.

The circuit breaker 10 is shown in FIG. 4 with one of the line lugs 17 removed to show the extension of the exhaust-seal 30 across the parting line 53 that joins the cover and the case in front of the arc chute 29. It is noted that one of the openings 35A having the dogbone configuration lies above the parting line and another one of the openings 35B having the dogbone configuration lies below the parting line to assure adequate exhaust gas venting from the top and bottom parts of the circuit breaker. The seal between the pedestal 41 and the line strap part 17A prevents the egress of gas therebetween as described earlier.

Having thus described our invention, what we claim as new and desire to secure by Letters Patent is:

1. A molded case circuit breaker comprising:

a plastic case and a plastic cover, said cover being attached to said case;

a fixed contact arm connected to a line terminal at one end of said case, said fixed contact arm carrying a fixed contact at one end thereof;

a first movable contact arm connected to a load terminal at an opposite end of said case, said first movable contact arm carrying a movable contact at one end thereof;

an operating mechanism within said case and arranged for separating said fixed and movable contacts upon occurrence of an overcurrent condition in excess of a predetermined magnitude;

an arc chute arranged over said movable contact arm for cooling and extinguishing an arc which occurs upon separation of said contacts;

a movable contact arm guide arranged intermediate said operating mechanism and said arc chute, said guide including opposing sidewalls thereby confining movement of said first movable contact arm to a predetermined direction; and a second moveable contact arm parallel to and electrically connected with said first movable contact arm, said first movable contact arm having means on a surface abutting said second contact arm for contacting said second contact arm and preventing said second contact arm from becoming distorted upon said overcurrent occurrence.

2. The circuit breaker of claim 1 including means on a surface of said second movable contact arm for contacting said first movable contact arm and preventing said first contact arm from becoming distorted upon said overcurrent occurrence.

3. The circuit breaker of claim 1 including a top piece on said guide, said top piece extending between and supporting said sidewalls.

4. The circuit breaker of claim 1 including an arc gas seal-exhaust unit intermediate said arc chute and said line terminal, said unit having means on a back plate for passage of arc gases generated by said arc.

5. The circuit breaker of claim 4 including a pedestal on said unit subjacent said sidewalls and overlying a part of said line terminals to seal said case from egress of said arc gases.

6. The circuit breaker of claim 5 wherein said unit comprises an elastomeric material.

7. The circuit breaker of claim 4 wherein said passage means comprises a slot.

8. The circuit breaker of claim 7 wherein said slot comprises a dogbone configuration.

9. The circuit breaker of claim 7 wherein said slot comprises a rectangular configuration.

10. The circuit breaker of claim 1 wherein said means comprises a protrusion integrally-formed on said first movable contact arm.

11. The circuit breaker of claim 3 wherein said means comprises a protrusion integrally-formed on said second contact arm.

* * * * *